United States Patent [19]

Rosier

[11] 4,217,489

[45] Aug. 12, 1980

[54] DEVICE FOR LOCATION-SENSITIVE DETECTION OF PHOTON AND/OR PARTICLE RADIATION

[75] Inventor: Jean-Claude Rosier, Paris, France

[73] Assignee: U.S. Philips Corporation, New York, N.Y.

[21] Appl. No.: 918,842

[22] Filed: Jun. 26, 1978

[30] Foreign Application Priority Data

Aug. 5, 1977 [FR] France ..... 77 24189

[51] Int. Cl.[2] ..... H01J 39/12

[52] U.S. Cl. ..... 250/207; 313/103 CM

[58] Field of Search ..... 250/207, 213 R, 213 VT; 313/103 CM, 105 CM

[56] References Cited

U.S. PATENT DOCUMENTS 3,947,841 3/1976 Tumolillo ..... 250/207

4,070,578 1/1978 Timothy et al. ..... 313/103 CM

*Primary Examiner*—David C. Nelms

*Attorney, Agent, or Firm*—Thomas A. Briody; Robert T. Mayer; Jack E. Haken

[57] ABSTRACT

An electron multiplier which is formed by at least two microchannel plates which are arranged one above the other and which operate in the saturation mode.

The second microchannel plate produces an output charge for each incident electron which depends on the electrical field in the vicinity of the input surface of said second plate. By suitable geometrical structure in the plate or by shaping the potential applied thereto, an electrical field is produced which varies from point to point on its input surface. The charge output thus contains information regarding the location of the incident electron.

19 Claims, 10 Drawing Figures

FIG.1
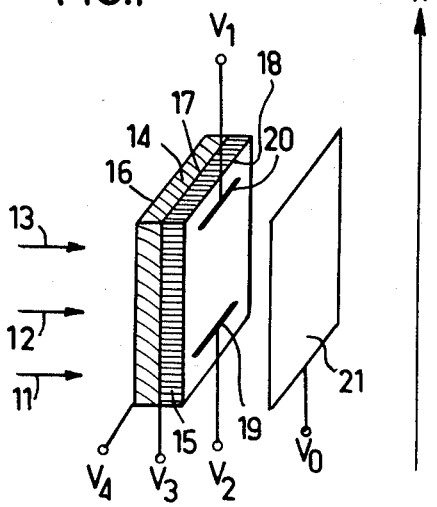
FIG.2
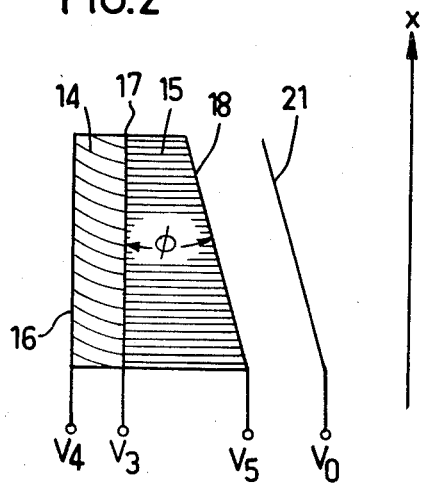
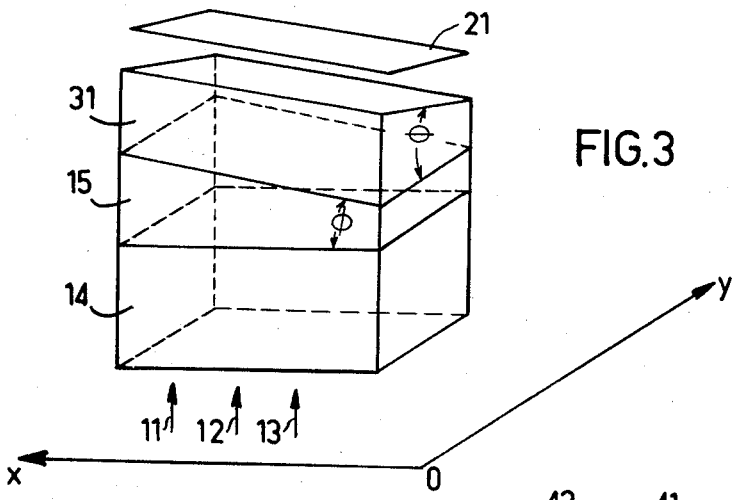
FIG.3
FIG.4
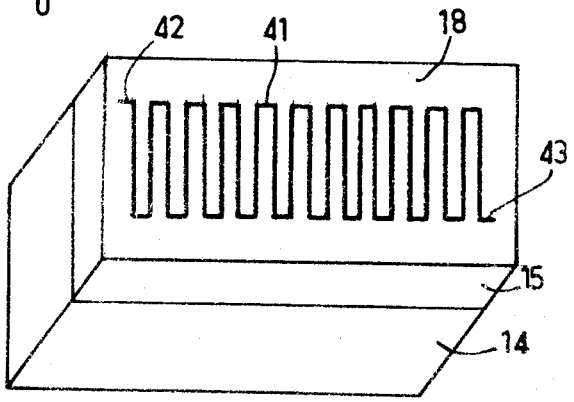

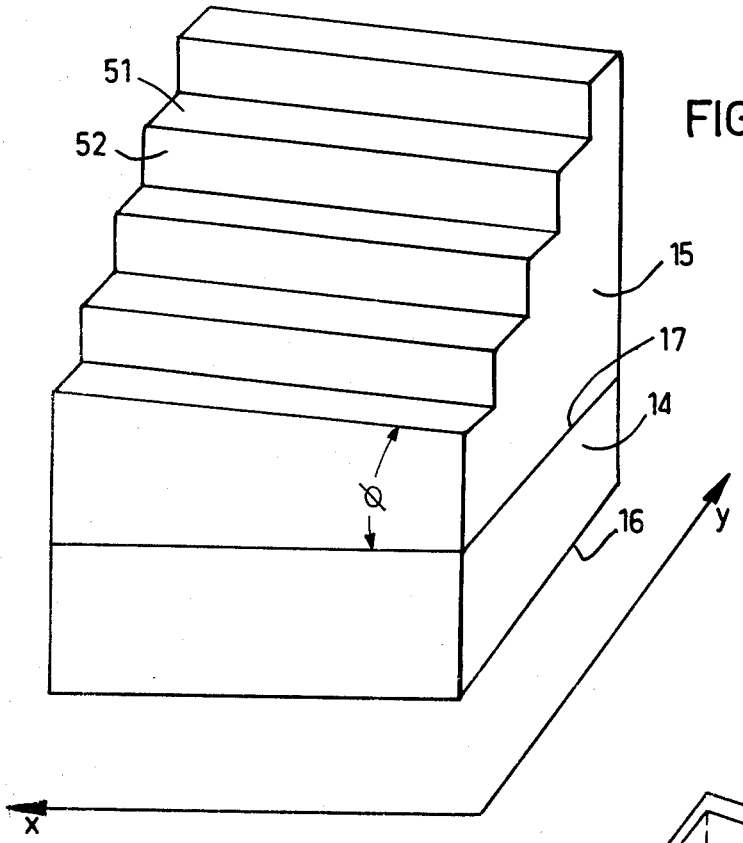
FIG.5
FIG.6
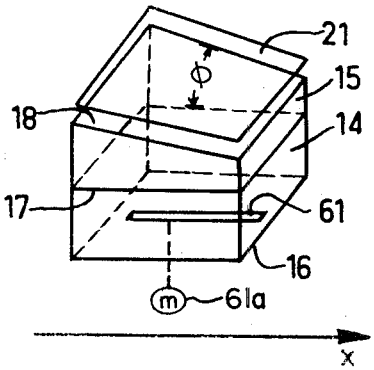
FIG.7
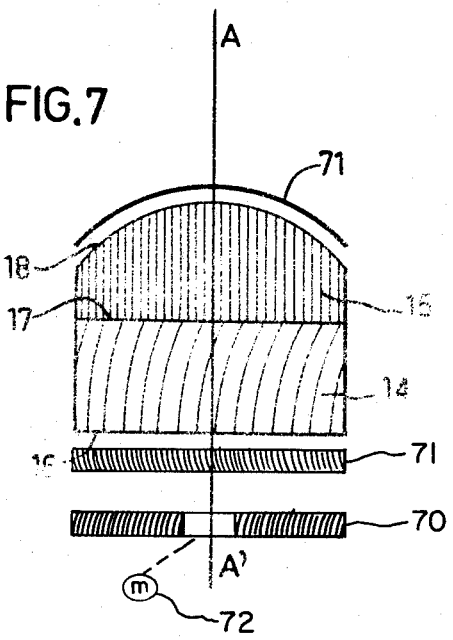

DEVICE FOR LOCATION-SENSITIVE DETECTION OF PHOTON AND/OR PARTICLE RADIATION

The invention relates to a device for location-sensitive detection of photon and/or particle radiation by means of microchannel plates having internal secondary electron emission. The microchannel plates operate in the saturation mode. The incident radiation is localized by measuring output charges.

In known devices comprising an electron multiplier formed by microchannel plates the multiplier serves exclusively for amplifying the signal, regardless of the location of the detected radiation. Location information does not directly follow from the use of the microchannel plate multiplier; additional means are required in order to obtain that information. The additional means generally comprise a collector which at least partly covers the output surface of the multiplier and which is formed, for example, by a multi-anode collector in the form of discrete anodes, a cross-bar system, a C.C.D. (Charge Coupled Device) collector, or a luminescent screen.

In a device in accordance with the invention additional means are not required. The location of the detected radiation is obtained by measuring the charge quantity detected on the output of the multiplier. The device is constructed so that the multiplication factor depends on the effective surface area of the multiplier and is subject to small variations (on the order of a few percent).

A prior art device which utilizes this property is described in the French Patent Application No. 7,707,591 filed on Mar. 15, 1977. In accordance with said application, a small variation of the multiplication factor is obtained by the use of two cascaded microchannel plates. Each channel of a first microchannel plate, which faces the incident radiation, operates in the charge saturation mode. The channels of the second microchannel plate operate in the zone saturation mode for each channel part used. In the first microchannel plate each individual electron is multiplied by a factor which is characterized by a single electron response (abbreviated S.E.R. and described in "Acta Electronica", Vo. 11, No. 1, pages 99–205, January 1971) having a Gaussian bell curve shape and a small width at half maximum $\Delta Q$. This corresponds to a resolution $(\Delta Q)/Q$ for the output charge Q of the first microchannel plate; said resolution is substantially smaller than 100%. The diameter of the microchannels in the second plate is much smaller than the diameter of the microchannels in the first plate. Every mean charge Q originating from a micro-channel of the first microchannel plate (corresponding, for example to an electron intercepted at the input of said channel) arrives on the input of a corresponding number of microchannels in the second plate. The mean charges at the output of the first plate are sufficiently large, and the magnitude variations $\pm(\Delta Q/2)$ of said charges are sufficiently small, to ensure that (taking into account the electrical potentials applied to the main faces of said second microchannel plate) said charges are subjected to a gain in said second microchannel plate which causes a zone saturation mode for each microchannel plate part used, regardless of the magnitude variations of said charges at the output of said first microchannel plate. Thus, each electron detected at the input of the first microchannel plate produces a substantially equal charge Qmax (which varies at the most by, for example, a few percent) which corresponds to the maximum charge which can be supplied, in the saturation mode, by each second microchannel plate part during the multiplication of each elementary charge. In accordance with said Patent Application, therefore, the ultimate result is a substantial reduction of variations of the multiplication factor so that the quantification of incident electronic charges at the input is maintained at the output, after amplification by a large factor. This is very important for the detection and the counting of said charges. However, no information is produced regarding the location of the incident radiation.

The device in accordance with the invention utilizes the above-described combined microchannel plates to achieve small variations of the multiplication factor, but the structure is changed to produce information regarding the location of the incident radiation.

The invention is based on the fact that the charge Qmax delivered by a microchannel plate part operating in the zone saturation mode is dependent to a high degree on the electrical field at the first electron multiplier stage in the microchannels. The invention comprises a structure which produces an electrical field distribution on the input of the microchannels of the second plate which varies in a direction substantially parallel to the surface of the plate. In this structure, a one-to-one relationship exists between the field strength and the location of zone struck by each radiation. The magnitude of the output charge Qmax, enables identification of the zone so that the incident radiation is localized. When $\epsilon$ denotes the dielectric constant of the microchannel plate material and S denotes the dielectric constant of the surface part of the second microchannel plate, the value of the corresponding output charge, as indicated in said French Patent Application, is an increasing function of the composite variable parameter:

$$\epsilon S(E_o - E_1) \simeq S(\Delta V/l - E_1) \quad (1)$$

in which $E_1$ is the electrical field on the output of the channels which corresponds to a multiplication factor 1 per multiplication level, $E_o$ is the field on the input which is approximately equal to the quotient of the potential difference $\Delta V$ between the main faces of the relevant microchannel plate part and its thickness l.

As a result, there are two possible embodiments for realizing the non-uniform distribution of the field $E_o$ at the first multiplication levels of the second microchannel plate.

In a first embodiment, the field distribution is produced by a uniform potential difference between the main surfaces of the second microchannel plate, which are separated with a thickness l which varies between points on the microchannel plate. In a second embodiment the thickness of the second microchannel plate is constant and the potential difference between the main surfaces of the plate varies from point to point.

In accordance with the invention, a device for detecting and localizing individual photon and/or particle radiation successively comprises (viewed in the direction of the radiation): a converter (if necessary) for converting the incident radiation into electrons; an electron multiplier including a first microchannel plate having parallel main surfaces and a second microchannel plate which is disposed against the output of the first microchannel plate; and a system for collecting and measuring the electrical charges produced at the output of the second microchannel plate. Different electrical potentials are applied to the main surfaces of said first and second plates, said potentials increase from the input surface of the first of the stacked microchannel plates to the direction of the output surface of the second plate. The diameter of the microchannels in the second plate is smaller than the diameter of the microchannels in the first plate. The electrical potentials applied to the main surfaces of the first plate are uniformly distributed across those main surfaces and are such that each microchannel of said first plate operates in the saturation mode for multiplication of a single electron. The potentials applied to the main surfaces of the second plate are such that the second plate locally operates in the zone saturation mode during multiplication of said charge produced by multiplication of a single electron in the first plate.

The geometrical structure of the second microchannel plate, in conjunction with the electrical potential on the output main surface thereof, ensures that the gain of said second microchannel plate, and hence the value of a charge corresponding to an incident radiation quantum, is dependent upon the location of incidence of said radiation. Preferably, the first microchannel plate comprises either curved microchannels or chevron-shaped microchannels which, in a known manner, reduce the risk of substantial ion feedback at very high multiplication factors (for example, $10^6$).

In a preferred embodiment of the invention the structure of the second microchannel plate and the electrical field distribution thereon are such that the location of the radiation can be detected line-wise in a detection plane. To this end, the second microchannel plate comprises flat input and output surfaces which form a dihedral angle. The output surface of the second plate is held at a uniform potential. The location of the radiation is measured in a direction perpendicular to the edge of the dihedral angle.

In accordance with a further embodiment the second microchannel plate comprises flat, parallel input and output surfaces and the potential applied to the output surface varies linearly in one direction and is constant in the direction of the perpendicular thereto.

In a further embodiment the structure of the second microchannel plate and the potential applied to the output main surface thereof enable indication of the location in two directions. The device comprises a second microchannel plate having flat, parallel input and output surfaces. The output surface is provided with a meandered resistance layer having an electrical potential difference applied between its ends. In a further embodiment, the output surface of the second microchannel plate comprises mutually parallel steps. The upper faces of the steps enclose an angle with the input main surface and the surfaces of all steps are held at the same potential.

Other embodiments which enable indication of the location of the radiation in two directions utilize microchannel plate structures which provide the location indication in a first direction, and further comprise a gap which scans the input of the device along a second direction which encloses an angle with the first direction. The gap may be provided in front of the converter which converts the incident radiation into electrons.

In a special embodiment, the location of the radiation is indicated in polar coordinates. The output main surface of the second microchannel plate is either concave or convex and is symmetrical around an axis which extends perpendicular to the output surface of the first microchannel plate; a uniform potential is applied to said output main surface of the second plate. The input of the device is scanned by a gap which rotates around the axis and which may be disposed in front of the radiation/electron converter.

At the limit of the resolution, said embodiments permit a resolution of on the order of 100 points across the width of the multiplier.

The invention will be described in detail hereinafter with reference to the accompanying drawings in which:

FIG. 1 is a perspective view of a device in which the second microchannel plate has a uniform thickness and the potential on the output surface of the second plate is non-uniform;

FIGS. 2 and 2*a* are sectional views of a device in which the second microchannel plate has a varying thickness;

FIGS. 2*b* and 2*c* are devices which utilize special anodes to localize radiation in two dimensions;

FIG. 3 is a perspective view of a device in which three microchannel plates are arranged one above the other and two of said plates have non-uniform thicknesses;

FIG. 4 is a perspective view of a device in which the second microchannel plate has a uniform thickness and the output main surface of this second plate is provided with a meandered resistance layer;

FIG. 5 is a perspective view of a device in which the second microchannel plate is step-shaped;

FIG. 6 is a perspective view of a device comprising a movable slit in front of the input main surface of the multiplier; and FIG. 7 is a sectional view of the device which indicates the location of the radiation in polar coordinates.

Figure 2A:
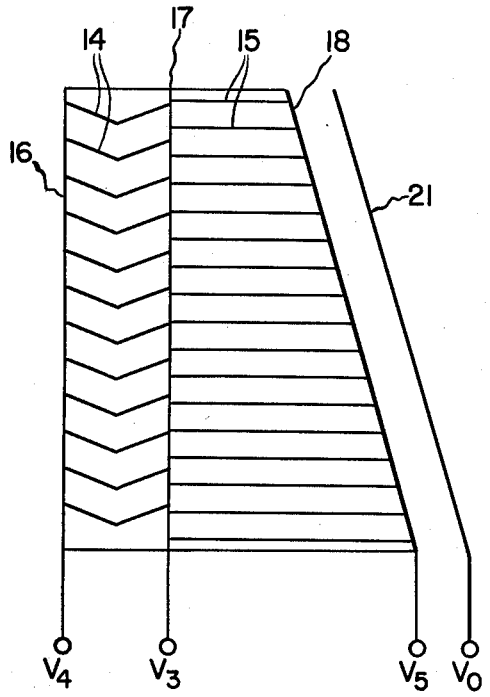

FIG. 1 is a perspective view of a part of the device. To improve clarity this Figure does not show a converter, which emits electrons under the influence of other radiation. In the case of photon radiation, for example, the converter may comprise a flat photocathode which is disposed near the input of the device. Arrows 11, 12, 13 indicate isolated, primary electrons which arrive on the input surface 16 of a first microchannel plate 14 having uniform thickness. A second microchannel plate 15, also having uniform thickness, has an input surface 17 disposed against an output surface of the first plate 14. The diameter d of the microchannels in the first plate 14 is much larger than the diameter d' of the microchannels in the second plate 15. The input and output surfaces of the two plates are metallized. The electrical resistance of the metallization on the main surfaces 16 and 17 is low, so that a uniform electrical potential is applied over the entire surface. ($V_4$ on input surface 16 and $V_3$ on interface surface 17.) However, the resistance of the metallization on the output surface 18 is very high. Two parallel metal strips 19 and 20 are provided on the metallization on surface 18; the electrical resistance of the strips is low. Different potentials $V_1$ and $V_2$ are applied to the strips so that the electrical potential on the output surface 18 varies linearly between the strips 19 and 20 parallel to the direction of the axis x. A charge collector in the form of a single anode 21 is disposed parallel to the output surface 18 and is connected to potential $V_0$. The applied potentials $V_0$, $V_1$, $V_2$, $V_3$, $V_4$ are such that throughout the device the electrical field is oriented from the input surface 16 towards the anode 21. The potential difference $\Delta V$ between the surfaces 17 and 18 varies linearly as a function of the distance x. The electrical potentials $V_0$, $V_1$, $V_2$, $V_3$, $V_4$ are adjusted so that the microchannel plates operate in the modes described above. An incident electron (for example, electron 12) is first multiplied by a large factor in a microchannel in the first microchannel plate 14, said channel operating in the individual saturation mode. In order to obtain a high multiplication factor (which may be for example, $10^7$) without substantial ion feedback, the first microchannel plate preferably comprises either curved microchannels or chevron-shaped microchannels. At the output of the first plate, electron multiplication gives rise to a charge Q, of which the variation $+(\Delta Q/2)$ at half maximum of the single electron response is such that the resolution $(\Delta Q)/Q$ is smaller than 100% and may be as low as 50%. The charge Q is uniformly distributed between the microchannels in the part of the second plate 15 situated adjacent the channel in the first plate 14 which delivers the charge Q. Taking into account the potentials $V_3$, and $V_1$, $V_2$, said second microchannel plate section operates in the zone saturation mode with an arbitrary charge variation $\pm(\Delta Q/2)$ on the input Q. The charge Qmax delivered at the output of the second plate 15 is given by formula (1). The value of this charge Qmax depends on the potential difference $\Delta V$ between the surfaces of the second plate 15, said potential difference varying with x. The value of said charge Qmax, intercepted on the anode 21, indicates the location of the incident radiation along axis x.

The first microchannel plate 14 may typically comprise curved channels; the ratio of the length L to the diameter d of the channels is 80; the diameter of the channels d is 40; the potential difference $V_3-V_4$ between the surfaces of the first microchannel plate 14 is approximately 1500 V, which for this plate results in a multiplication factor of approximately $10^6$ for a single electron and a resolution $(\Delta Q)/Q$ of approximately 50%. The second microchannel plate 15 may comprise straight channels; the ratio L/d is 40, while the diameter of the channels is 12.5$\mu$. The distance between the strips 19 and 20 may, for example, be 3 cm. The potential difference $V_1-V_2$ is 600 V, which implies a multiplication factor for a single electron which varies along the x axis from $5.10^5$ to $5.10^7$. Thus, at the output of the second microchannel plate n points can be differentiated, in which $$n \simeq \text{Log } 100/\text{Log } 1.06 \simeq 79.$$

FIGS. 2 and 2*a* are sectional views of a second device in accordance with the invention. First and second microchannel plates 14 and 15 are arranged one against the other along intermediate surface 17. For reasons as already described, the first plate 14 preferably comprises curved (FIG. 2) or chevron-shaped (FIG. 2*a*) channels. The second plate 15 comprises channels of different lengths. The surfaces 17 and 18 of the second plate 15 are, for example, flat and enclose a dihedral angle $\phi$. An anode 21 is disposed parallel to surface 18. Surfaces 16, 17 and 18 respectively are connected to potentials $V_4$, $V_3$ and $V_5$. These potentials are such that the electrical field is oriented from surface 16 towards anode 21. Moreover, the said potentials are such the microchannels of plates 14 and 15 operate in the same modes as in the embodiment of FIG. 1. The charge Qmax which is delivered at the output by each part of the plate 15 and corresponds to one incident electron detected by the plate 14 is a function of the thickness of the local area of the plate in accordance with the formula (1). This thickness varies along the axis x. Measurement of the charge intercepted by the anode 21 allows location of the incident radiation along axis x.

In an alternative embodiment, which produces a charge $Q_{max}$ which linearly varies with the distance x, the surface 18 of the plate 15 is profiled such that the thickness l varies according to a hyperbolic function of x.

Figure 2B:
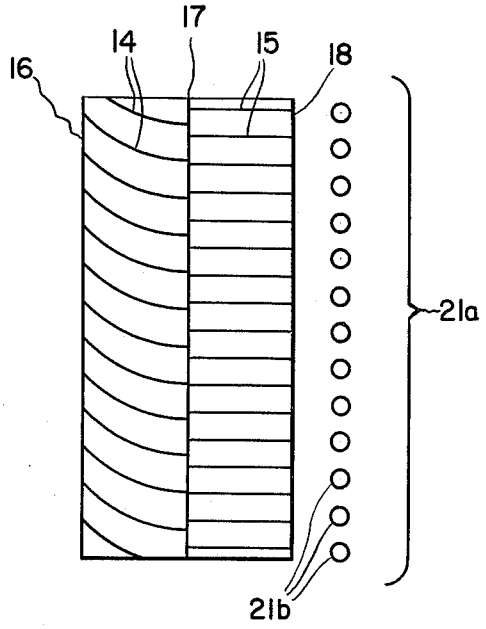
Figure 2C:
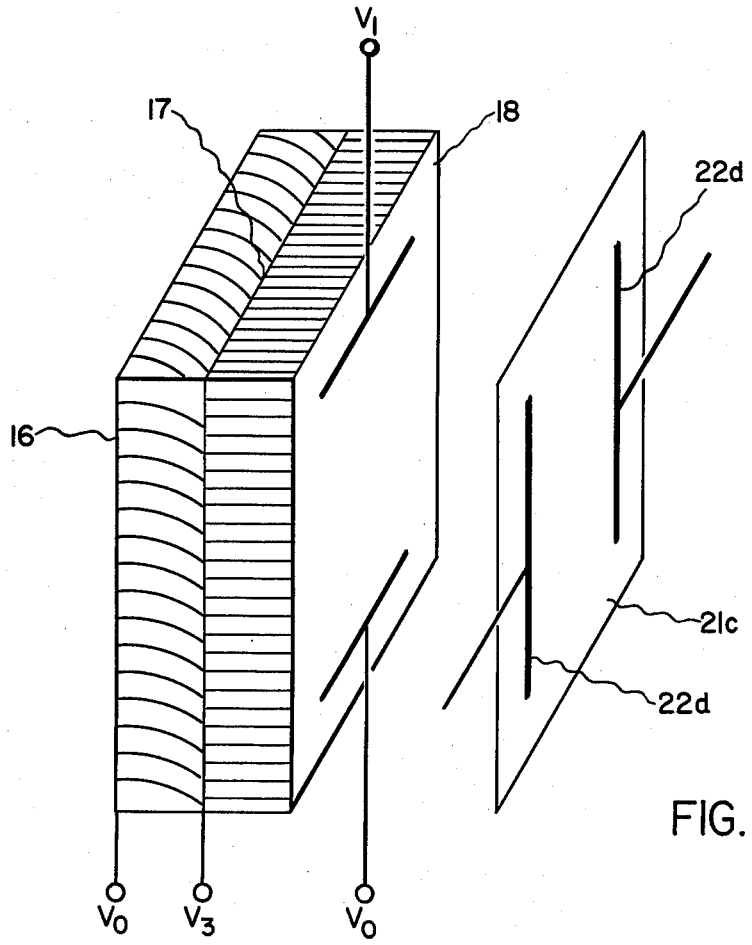

In order to obtain the second coordinate of the location of the incident radiation the single collector of the device shown in FIG. 1 or FIG. 2 may be replaced (FIG. 2*b*) by a collector 21*a* comprising wires 21*b* which extend parallel to, for example, the direction x or (FIG. 2*c*) by a resistance anode 21*c* which is provided with two parallel electrodes 22*d* on its ends. The location of the radiation is then electronically denoted by measurement of the ratio of the charge quantities collected on the two electrodes.

In order to localize the incident radiation in two directions another multiplier, which comprises three microchannel plates arranged one above the other and in contact with each other, is shown in perspective in FIG. 3. The microchannel plates 14 and 15 are identical to the plates denoted by the reference numerals 14 and 15 in FIG. 2 and operate in the same manner. At the output of the second plate 15, the charge $Q_{(x)}$ collected on the metallization which is common to the plates 15, 31 is a function of the coordinate x. The third microchannel plate 31 is disposed above the second plate 15 and is wedge-shaped; the orthogonal section thereof has a side which is parallel to axis y. The electrical potentials powering the surfaces of the microchannel plates are such that the third plate 31 also operates in the zone saturation mode when said plate multiplies the charge $Q_{(x)}$ in order to deliver a charge $Q_{y(x)}$ which is dependent of $Q_{(x)}$. The quantities $Q_{(x)}$ and $Q_{y(x)}$ are simultaneously processed by an arithmetic device to determine y. The diameter of the channels in the third plate 31 is much smaller than the diameter of the channels in the second plate 15.

FIG. 4 shows a further embodiment for localization of incident radiation in two coordinates by use of two microchannel plates 14 and 15. The metallization provided on the output surface 18 of the second plate 15 is formed by meandered resistance strip 41. Different potentials $V_1$ and $V_2$ are applied to the ends 42 and 43 of the strip 41. A potential difference thus exists between the surfaces of the plate 15, which varies from one point on the plate to another, so that the charge $Q_{max}$ on the output of the plate 15 is characteristic of the location of the incident radiation.

In a further embodiment the localization of incident radiation in two coordinates is achieved by a special construction of the second plate 15. This construction is shown in perspective in FIG. 5. This embodiment includes a first microchannel plate 14, the channels of which are, for example, curved. At its output surface, the second microchannel plate 15 is stepped, the steps thus formed being identical and parallel. The tops and the sides of said steps are disposed in perpendicular planes. The top of one of said steps is denoted by the reference 51, while the side is denoted by the reference 52. The microchannels open substantially perpendicular to the tops of the steps and are parallel to the sides. The sides of the dihedral angles $\phi$ between the surface 17 of the plate 15 and a top of a step are parallel to the axis y.

The axis x is parallel to the line of intersection of the plane of the step sides and the surface 17. The length of the microchannels associated with each step depends only of the value x, and varies step-wise from one step to another in the direction y. The tops of the steps are metallized and connected to the same electrical potential, so that all steps on the second plate 15 operate in the zone saturation mode. The charge $Q_{max}$ which is available at the output of a step and which satisfies the formula (1) is then dependent only on the coordinate x and on the step used thus enabling information to be obtained in accordance with the coordinates y. This information is more accurate if the steps are narrow.

In further embodiments, combined microchannel plates 14 and 15 are only used for localization of radiation along a single coordinate, the other coordinate is determined by sequential analysis means which are displaced past the input or output of the system. FIG. 6 shows such an embodiment. The first coordinate x is determined by means of two microchannel plates 14 and 15, the length of the microchannels in the second plate 15 varying only in the direction x. This is the device which has already been described with reference to FIG. 2. A slit 61 is moved by drive means 61*a* at a constant speed in front of either the input surface of the first plate 14 or the means for delivering the electrons, said slit being directed perpendicular to the edge of the dihedral angle $\phi$ formed by the surfaces 17 and 18. The position of the slit determines the second coordinate y. The movement of the slit may be synchronous with a time base which is switched at the same instant as said movement. The slit may have different forms: it may be a mechanical slit (i.e., an aperture in a moving screen), or it may be an electro-optical slit, for example, a transparent region in an electrically controlled material (i.e., a liquid crystal).

In a further embodiment, shown in cross-section in FIG. 7, the multiplier stage comprises a first microchannel plate 14, having curved microchannels 14*a* and parallel surfaces 16 and 17 and a second microchannel plate 15 which is arranged against the plate 14 but whose output surface 18 is curved (i.e. concave or convex). A collector anode 71, having the same shape as the output surface 18, is arranged in the vicinity of surface 18. The axis AA' is a symmetry axis of rotation. Zones of constant multiplication factor, which are represented by concentric circles of faces extending perpendicularly to the axis AA' centered on this axis are situated on the output of the second plate. A slit 70 is disposed in front of the means 71, which convert the radiation into electrons, one of the ends of which occupies a fixed position on the axis AA' is rotated around this axis in a plane extending perpendicular to this axis by drive means 72. Thus, localization of the radiation is obtained in polar coordinates. One coordinate is obtained by measurement of the charge $Q_{max}$ on the anode 71, while the other coordinate is obtained by measurement of the position of the slit.

What is claimed is:

1. A device for detecting and localizing electrons comprising, in combination:

a first microchannel plate having parallel input and output surfaces;

a second microchannel plate having a flat input surface disposed adjacent the output surface of the first plate and an output surface, the diameter of microchannels in the first plate being smaller than the diameter of microchannels in the second plate;

means for collecting and measuring electric charge produced at the output surface of the second plate;

means which apply electric potentials to the surfaces of the plates which function to produce an electric field which is directed from the input surface of the first plate to the means for collecting and measuring, to operate microchannels in the first plate in the saturation mode for multiplication of a single electron, and to locally operate microchannels in the second plate in the zone saturation mode during multiplication of the charge produced by single electron multiplication in the first plate; and means which cause the gain of the second plate to vary as a function of position on the second plate.

2. A device as claimed in claim 1 further comprising means disposed adjacent the input surface of the first plate which function to convert quanta of incident radiation into electrons.

3. A device as claimed in claim 1, wherein the channels in the first microchannel plate are curved.

4. A device as claimed in claim 1, 2 or 3, wherein the input and output surfaces of the second microchannel plate form a dihedral angle and the electrical potential is uniform over each of the surfaces of the second plate.

5. A device as claimed in claim 4, wherein the output surface of the second microchannel plate comprises part of a hyperbolic cylinder whose describing lines are parallel to the apex of the dihedral angle and which is shaped so that, in a plate cross-section through a plane extending perpendicular to the apex, the relation between the distance from points on the output surface to their perpendicular projections on the input surface and the coordinate of said projection, measured perpendicular to the apex, is hyperbolic.

6. A device as claimed in claim 1, 2 or 3, wherein the surfaces of the second microchannel plate are parllel;

a uniform electrical potential is applied over the input surface of the second plate; and a non-uniform electrical potential is applied over the output surface of the second plate.

7. A device as claimed in claim 6, wherein the means which apply electric potentials include a layer having a high electrical resistance disposed on the output surface of the second plate, two parallel metal strips having low electrical resistance disposed on the layer and means which apply a potential difference between the strips.

8. A device as claimed in claim 6, wherein the means which apply electrical potentials include a meandering strip-shaped resistance layer disposed on the output surface of the second plate, and means which apply a potential difference between the ends of the strip.

9. A device as claimed in claim 1, 2 or 3 wherein the output surface of the second microchannel plate is curved and is rotationally-symmetric around an axis which is perpendicular to the surfaces of the first microchannel plate, a constant electrical potential being applied to the output surface of the second plate.

10. A device as claimed in claim 9 wherein the curved output surface is concave.

11. A device as claimed in claim 9 wherein the curved output surface is convex.

12. A device as claimed in claim 1, 2 or 3 wherein the output surface of the second microchannel plate is step-shaped, the tops of the steps being parallel, the step tops and the input surface of the second microchannel plate forming a dihedral angle, and wherein a uniform electrical potential is applied to all step tops.

13. A device as claimed in claim 1, 2 or 3 wherein the input and output surfaces of the second microchannel plate are flat and form a first dihedral angle, and further comprising a third microchannel plate having flat input and output surfaces which form a second dihedral angle, the input surface of the third plate being disposed adjacent the output surface of the second microchannel plate, the diameter of the micro-channels in the third plate being smaller than the diameter of the microchannels in the second plate, the first and second dihedral angles being oriented in different directions and the electrical potential being uniform over each surface of the third plate.

14. A device as claimed in claims 1, 2 or 3 wherein the means for collecting comprise parallel wires disposed in the vicinity of the output surface of the second microchannel plate.

15. A device as claimed claims 1, 2 or 3 wherein the means for collecting comprise a resistive anode which includes two parallel electrodes at its ends and which is disposed in the vicinity of the output surface of the second microchannel plate.

16. A device as claimed in claim 1 further comprising a slit which is disposed adjacent the input main surface of the first microchannel plate and means for displacing the slit in a direction parallel to the input surface.

17. A device as claimed in claim 16 wherein the slit is disposed in front of means which convert quanta of incident radiation into electrons.

18. A device as claimed in claim 1 wherein the channels in the first microchannel plate are cheveron-shaped.

19. A device as claimed in claim 9, further comprising a slit which is disposed in front of the input main surface of the first microchannel plate and which rotates around the axis of symmetry of the output surface of the second microchannel plate, and means for rotating the slit around the axis.

* * * * *

UNITED STATES PATENT AND TRADEMARK OFFICE

CERTIFICATE OF CORRECTION

PATENT NO. : 4,217,489

DATED : August 12, 1980

INVENTOR(S) : JEAN-CLAUDE ROSIER

It is certified that error appears in the above-identified patent and that said Letters Patent are hereby corrected as shown below:

Column 7 Line 67 change "first" to --second--

Column 7 Line 68 change "second" to --first--

Signed and Sealed this

*Eighth* Day of *September 1981*

[SEAL]

*Attest:*

GERALD J. MOSSINGHOFF

*Attesting Officer* *Commissioner of Patents and Trademarks*